US007077797B2

(12) United States Patent
Villanueva et al.

(10) Patent No.: US 7,077,797 B2
(45) Date of Patent: Jul. 18, 2006

(54) APPARATUS AND METHOD FOR CREASING MEDIA TO MAKE BOOKLETS

(75) Inventors: Jose Alvaro Barba Villanueva, Jalisco (MX); Robert J. Lawton, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/949,125

(22) Filed: Sep. 24, 2004

(65) Prior Publication Data

US 2005/0035520 A1 Feb. 17, 2005

Related U.S. Application Data

(62) Division of application No. 10/426,272, filed on Apr. 30, 2003, now Pat. No. 6,827,679.

(51) Int. Cl.
*B31F 1/10* (2006.01)

(52) U.S. Cl. ..... 493/395; 493/397; 493/399; 493/405; 493/419; 493/231; 493/243

(58) Field of Classification Search ..... 493/395–402, 493/405, 419, 231, 243, 228; 270/52.26, 270/52.29, 32, 37

See application file for complete search history.

(56) References Cited

U.S. PATENT DOCUMENTS

| | | | | |
|---|---|---|---|---|
| 3,975,009 | A * | 8/1976 | Brown | 493/14 |
| 4,198,039 | A * | 4/1980 | Bryson et al. | 270/52.29 |
| 4,784,379 | A * | 11/1988 | Vander Syde et al. | 270/58.06 |
| 4,850,945 | A * | 7/1989 | Whittenberger | 493/14 |
| 5,092,832 | A * | 3/1992 | Crowley | 493/421 |
| 6,095,740 | A * | 8/2000 | Hollenstein et al. | 412/4 |
| 6,363,851 | B1 * | 4/2002 | Gerhard et al. | 101/483 |
| 6,503,181 | B1 * | 1/2003 | Pons | 493/130 |
| 6,676,121 | B1 * | 1/2004 | Scholta | 270/52.17 |

* cited by examiner

*Primary Examiner*—Stephen F. Gerrity
*Assistant Examiner*—Hemant M. Desai
(74) *Attorney, Agent, or Firm*—James R. McDaniel

(57) ABSTRACT

This invention relates to an apparatus and method for making booklets. Such structures of this type, generally, employ a variety of creasing techniques in order to form the booklet.

11 Claims, 11 Drawing Sheets

APPARATUS AND METHOD FOR CREASING MEDIA TO MAKE BOOKLETS

This application is a divisional of U.S. application Ser. No. 10/426,272 filed Apr. 30, 2003, now U.S. Pat. No. 6,827,679 issued on Dec. 7, 2004.

BACKGROUND OF THE INVENTION

1. Field of the Invention

This invention relates to an apparatus and method for making booklets. Such structures of this type, generally, employ a variety of creasing techniques in order to form the booklet.

2. Description of the Related Art

Prior to the present invention, as set forth in general terms above and more specifically below, it is known, in conventional booklets making processes to accumulate the media sheets flat, staple the accumulated media, and fold all of the bundled sheets together. The trimming operation is done at the very last by employing a large, powerful, industrial guillotine to trim all the sheets at once. This folding approach is inefficient and requires a lot of power. Also, undesired raised areas or "pillowing" are commonly located near the crease. While this method is traditionally the fastest way of forming a booklet in industrial environments where large quantities of booklets are being produced, the pillowing defect is not recognized as a quality item and, therefore, no attention is being paid to it. It is also known, in the booklet making art, to employ a sheet-by-sheet booklet making process. The disadvantage of this process is that the pages of the booklet were scored and creased in a single point at the middle as shown in FIG. 1*a*. As can be seen in FIG. 1*b*, undesired raised areas or "pillowing" resulted from this technique.

It is further known, in the booklet making art, to accumulate the sheets of media in a flat position, staple the sheets of media in order to form a bundle, fold all of the sheets of media at once, and eject them from the booklet making apparatus. This apparatus does not trim the booklet, which results in creeping or a chevron-like defect. However, this creeping issue does not seem to present a serious problem since the booklets typically contain less than 10 sheets. On the other hand, pillowing is a serious result from using this device along with the large amount of power required to fold the booklets. Consequently, a more advantageous system, then, would be presented if the booklet making apparatus could efficiently produce booklets while eliminating creeping and pillowing.

Finally, it is known, in the booklet making art, to produce a booklet having a multiple position hinge. Exemplary of such prior art is U.S. Pat. No. 6,363,851 ('851) to J. Gerhard et al., entitled "Process for Producing Folded, Bound Printed Products, and the Printed Product Produced." While the '851 reference employs a multiple position hinge, the edges of the booklet are not trimmed which results in the creeping or chevron-like defect.

It is apparent from the above that there exists a need in the art for a booklet making apparatus which is efficient in terms of power consumption, and which is capable of eliminating pillowing, but which at the same time is capable eliminating creeping of the media sheet edges. It is a purpose of this invention to fulfill this and other needs in the art in a manner more apparent to the skilled artisan once given the following disclosure.

SUMMARY OF THE INVENTION

Generally speaking, an embodiment of this invention fulfills these needs by providing a method for making a booklet, wherein the method is comprised of the steps of: locating a sheet of media substantially within a creasing device; creasing, on both sides, the sheet of media at a plurality of locations along the sheet of media; collecting the creased sheets of media until a desired number of creased sheets of media has been achieved; fastening the desired number of creased sheets of media to form a booklet; and ejecting the fastened booklet.

In certain preferred embodiments, the pre-cut sheets of media are cut at various lengths in order to reduce creeping and eliminate a booklet trimming step. Also, the pre-cut sheets of media can be creased through the use of a variety of folding techniques. Finally, a stapling device can be used to fasten the desired number of sheets in order to form a booklet.

In another further preferred embodiment, the power required to complete the booklet is substantially reduced because each individual sheet of media is creased alone. Also, the creeping effect is eliminated due to the use of the pre-cut sheets. Finally, the pillowing defect is eliminated due to the use of the multiple crease hinge.

The preferred booklet making method, according to various embodiments of the present invention, offers the following advantages: ease-of-use; reduced power consumption; lightness in weight; good stability; good durability; excellent economy; reduced pillowing; and creep elimination. In fact, in many of the preferred embodiments, these factors of ease-of-use, reduced power consumption, economy, reduced pillowing, and creep elimination are optimized to an extent that is considerably higher than heretofore achieved in prior, known booklet making methods.

The above and other features of the present invention, which will become more apparent as the description proceeds, are best understood by considering the following detailed description in conjunction with the accompanying drawings, wherein like characters represent like parts throughout the several views and in which:

DETAILED DESCRIPTION OF THE INVENTION

Figure 1A:
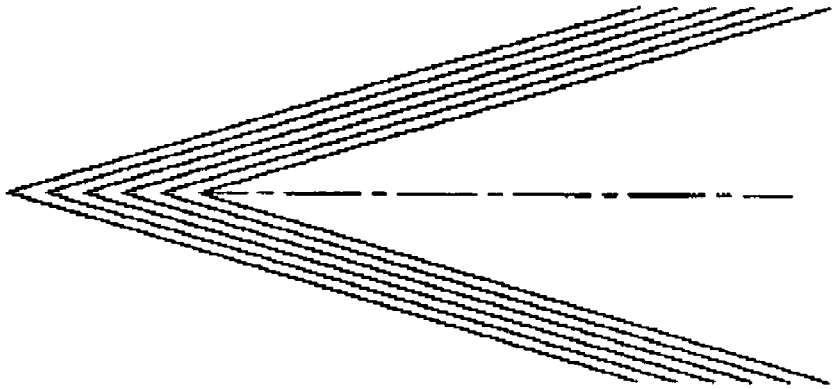
FIG. 1a (Prior Art)
FIG. 1 is a schematic illustration of a prior art booklet making technique wherein single folded sheets are accumulated (FIG. 1*a*) and the sheets are fastened whereupon a pillowing defect results (FIG. 1*b*)
Figure 1B:
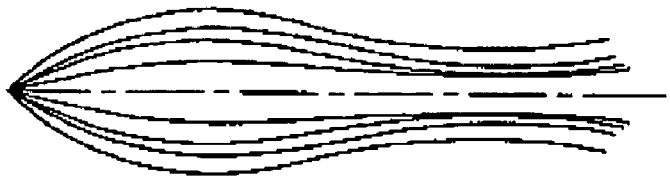
FIG. 1b (Prior Art)

With reference first to FIG. 1, creasing is an essential process in booklet making. In standard industry processes for booklet making, the booklet is creased (folded) once it is finished (FIG. 1*a*) and stitched. The last operation is trimming. However, as discussed above, this created a pillowing defect (FIG. 1*b*). The present invention is related to a different approach in booklet making. In one embodiment of the present invention, the sheets of the booklet are processed one-by-one and subsequently stitched in order to complete the booklet.

Another important aspect of the present invention is that the previously discussed "creep" defect can be eliminated. Creep is caused when the inside sheets of the booklet appear to be longer then the outside sheets when they are actually the same size. This creep defect can be eliminated by trimming each sheet progressively to a different length in order to leave the outside sheets of the booklet longer than the inside sheets of the booklet. Trimming the sheets in this controlled manner will make the edge of the booklet flat, thereby eliminating the creep defect.

Figure 2A:
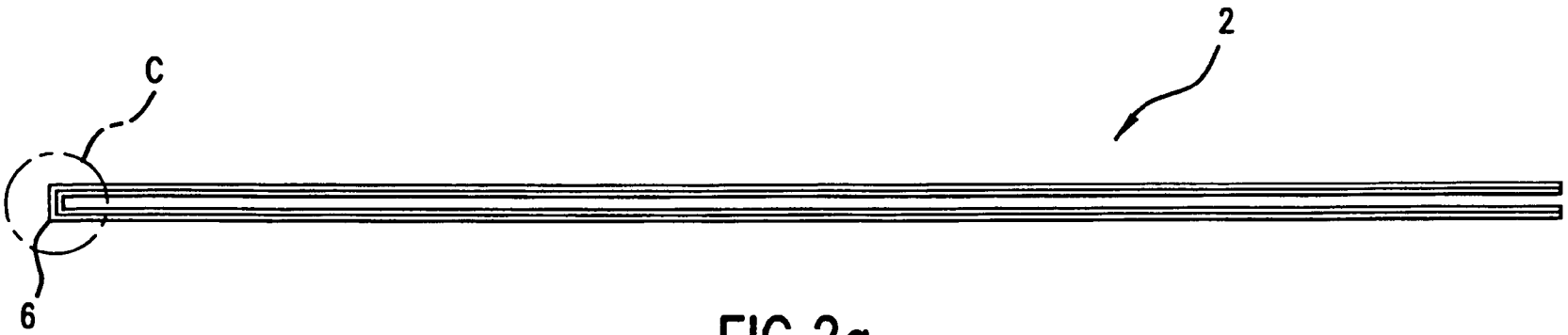
FIG. 2 is a schematic illustration showing how each pre-cut sheet is creased in two points
(FIG. 2*b* is a blown up view of the booklet spine shown in FIG. 2*a*), according to an embodiment of the present invention.
Figure 2B:
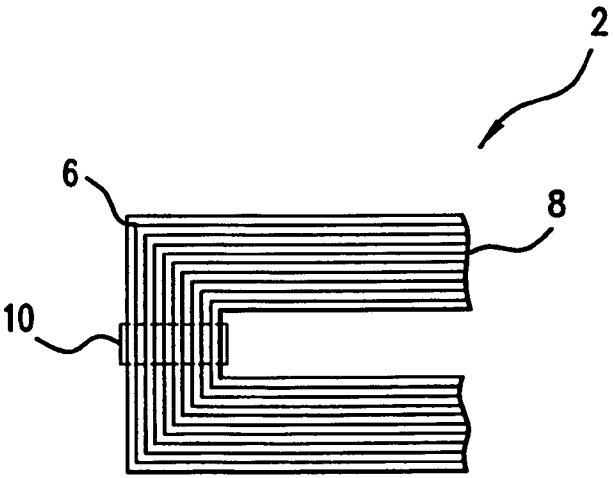

With respect to FIG. 2, one embodiment of the present invention is to take advantage of the precision drive mechanism (not shown) for progressively trimming each sheet to a different length in order to leave the outside sheets of the booklet longer then the inside sheets of the booklet. It is to be understood that the various sheets of the booklet could be cut shorter/longer in order to provide index pages for the booklet. As can be seen in FIGS. 2*a* and 2*b*, media sheet 8 is not folded at the exact middle of the sheet, but at two creases 6 centered about the middle. The distance between these two creases 6 will change from page-to-page according to its position in booklet 2. For example, those creases 6 in the inside sheets 8 will be closer than the outside ones. It is to be understood that the inner most sheets could even be folded just once at the middle then two creases 6 could be used from the third sheet on out. It is to be understood that creases 6 between adjacent sheets 8 are located in close proximity to each other and the position between creases 6 of adjacent sheet 8 can be programmable. Finally, fastener 10 is conventionally used to stitch the various sheets of media together in order to form booklet 2 after sheets 8 are centered with respect to the device (not shown) for inserting fastener 10. Preferably, fastener 10 is a staple. In short, this crease distance variation will provide booklet 2 with a "square spine" with the additional advantage that it provides multiple hinge points.

Figure 3:
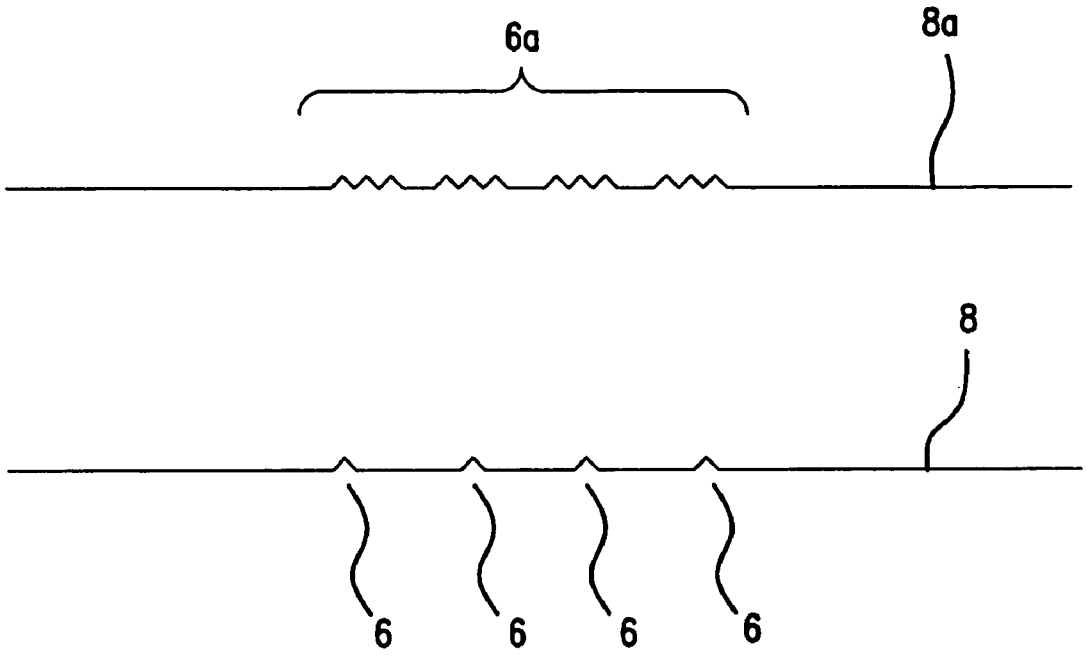
FIG. 3 is a schematic illustration of a programmable, continuous, double fold crease and a programmable, discrete, double fold crease, according to another embodiment of the present invention.

With respect to FIG. 3, there is illustrated sheet 8*a* that includes a programmable, continuous, double fold crease 6*a* and sheet 8 that includes a programmable, discrete, double fold crease 6. As can be seen in the Figure, the continuous creases 6*a*, that were normally located exactly opposite of each other on sheet 8 (discrete creases 8), are now located at an offset location from each other on opposites sides of the same sheet 8*a*. This continuous crease 6*a* could provide a rounded edge for the booklet, if that is desired.

Figure 4A:
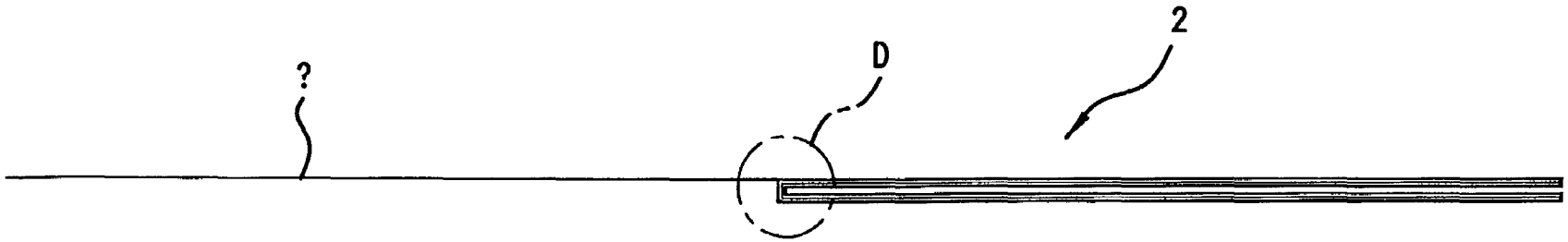
FIG. 4 is a schematic illustration showing how the booklet lays flat
(FIG. 4*b* is a blown up view of the booklet spine shown in FIG. 4*a*), according to another embodiment of the present invention.
Figure 4B:
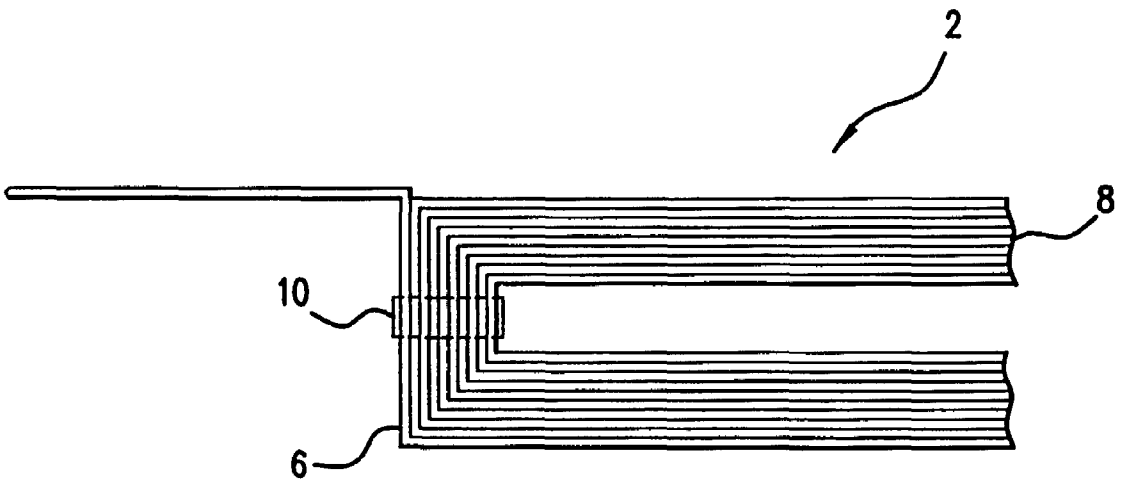

With respect to FIG. 4, booklet 2 is illustrated. As shown in FIGS. 4*a* and 4*b*, booklet 2 lays flat since each sheet 8 has two hinge points or creases 6. The "square spine" behaves as that of the perfectly bound book. The difference is that booklet 2 is fastened with only a couple of fasteners 10.

Another aspect of the present invention is the use of a discrete/continuous, double fold process for attaining a better crease. A double fold is created by creasing the media on one side of the media and then creasing the media again at that exact location, but on the opposite side of the media. Essentially, this breaks the media's fibers more efficiently and reduces the media's resilience or tendency to recover its original shape. Variations of this double fold process will be discussed below.

With respect to FIG. 5, there is illustrated one embodiment for creasing sheets of media. FIG. 5 shows apparatus 20 for creating a double fold for creasing sheets 8 of media. Apparatus 20 includes, in part, media sheet 8, media guide 22, media transport rollers 24, media sheet guide plate 26, media drive rollers 28, pivotable media bail clamp 30, media bail clamp 32, and crease wheel 34.

Media sheet 8, preferably, is any suitable media that can be formed into the booklet. Media guide 22, preferably, is constructed of any suitable, durable material that is capable of being formed into a curvilinear shape. Media transport rollers 24, preferably, are constructed of any suitable, durable material that is capable of transporting media sheet 8 towards media sheet guide plate 26. Media sheet guide plate 26, preferably, is constructed of any suitable, durable material that is capable of allowing media sheet 8 to traverse from media clamp 30 to media clamp 32. Media drive rollers 28, preferably, are any suitable drive rollers that are capable of traversing media sheet 8 a predetermined distance along media sheet guide plate 26 in order to form creases at desired positions along media sheet 8. Media clamp 30, preferably, is constructed of any suitable, durable material that is capable of securing media sheet 8 against media sheet guide plate 26, such as by pivoting. Media clamp 32, preferably, is constructed of any suitable, durable material that is capable of retaining media sheet 8 against media sheet had plate 26. Crease wheel 34, preferably, is constructed of any suitable, durable material that is capable of pushing a portion of media sheet 8 against an edge of media sheet guide plate 26 in order to form a crease in media sheet 8.

Figure 5A:
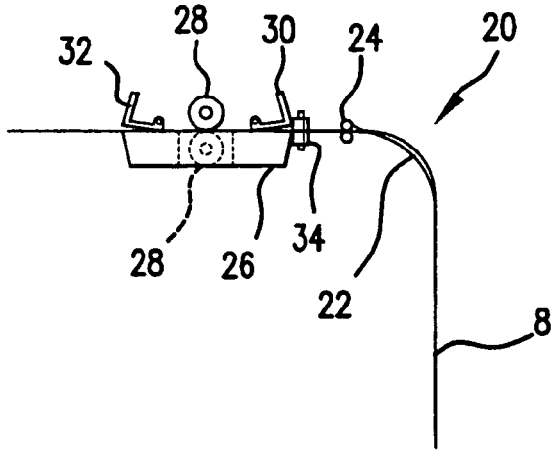
FIG. 5 is a schematic illustration of the steps (FIG. 5*a*–FIG. 5*c*) for completing a buckle double fold, according to another embodiment of the present invention.

During the operation of apparatus 20, as shown in FIG. 5*a*, media sheet 8 is conventionally fed along media guide 22 such that media sheet 8 interacts with media transport rollers 24. Media transport rollers 24 cause media sheet 8 to slide along media sheet guide plate 26 and under media bail clamps 30 and 32. At this point, crease wheel 34 is not in contact with media sheet 8 and media drive rollers 28 take control of media sheet 8 and attempt to locate the predetermined crease points along media sheet 8.

Figure 5B:
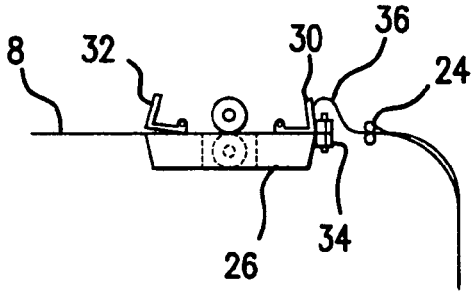

As shown in FIG. 5*b*, media bail clamp 30 pivots and secures media sheet 8 against media sheet guide plate 26 while media transport rollers 24 continue to force media sheet 8 towards media sheet guide plate 26. At this point, buckle 36 is formed. Once buckle 36 is formed, crease wheel 34 moves in a direction orthogonal to the path of media sheet 8 in order to create a crease in media sheet 8 in one direction.

Figure 5C:
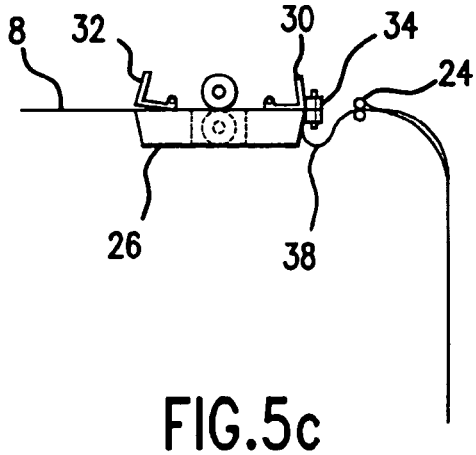

As shown in FIG. 5*c*, the direction of rotation of media transport rollers 24 is reversed and media sheet 8 is forced downward by conventional means to make sure the when the direction of rotation of media transport rollers 24 is again reversed buckle 38 will be created. Once buckle 38 is formed, crease wheel 34 moves in a direction orthogonal to the path of media sheet 8 in order to create a crease in media sheet 8 in the same location on media sheet 8, but on the other side of media sheet 8. Media drive rollers 28 are then utilized in order to traverse media sheet 8 along media sheet guide plate 26 so that predetermined points along media sheet 8 can be creased.

Figure 6A:
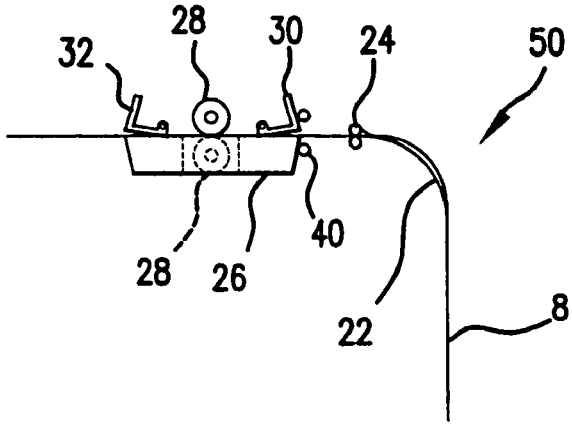
FIG. 6 is a schematic illustration of the steps (FIG. 6*a*–FIG. 6*c*) for completing a roller double fold, according to another embodiment of the present invention.
Figure 6B:
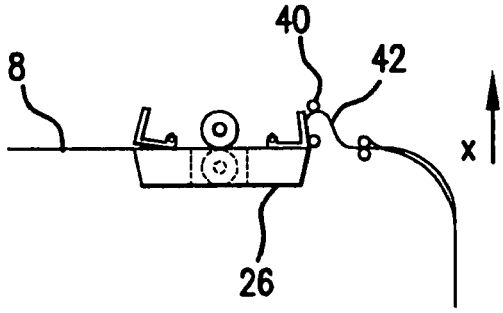
Figure 6C:
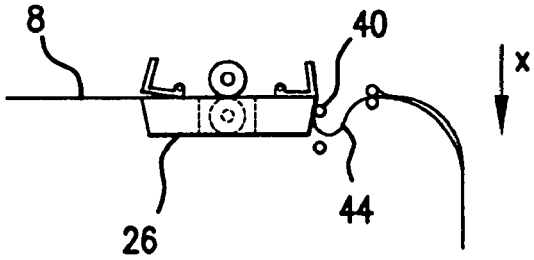

With respect to FIG. 6, there is illustrated another embodiment for creasing media sheet 8. FIGS. 6*a*–6*c* illustrate apparatus 50 for creating a roller double fold for creasing media sheet 8. Apparatus 50 includes, in part, media sheet 8, media guide 22, media transport rollers 24, media sheet guide plate 26, media drive rollers 28, pivotable media bail clamp 30, media bail clamp 32, and page wide rollers 40.

Page wide rollers 40, preferably, are constructed of any suitable, durable material that is capable of pushing a portion of media sheet 8 against an edge of media sheet guide plate 26 in order to form a crease in media sheet 8.

During the operation of apparatus 50, as shown in FIG. 6*a*, media sheet 8 is conventionally fed along media guide 22 such that media sheet 8 interacts with media transport rollers 24. Media transport rollers 24 cause media sheet 8 to slide along media sheet guide plate 26 and under media bail clamps 30 and 32. At this point, page wide rollers 40 are not in contact with media sheet 8 and media drive rollers 28 take control of media sheet 8 and attempt to locate the predetermined crease points along media sheet 8.

As shown in FIG. 6*b*, media bail clamp 30 pivots and secures media sheet 8 against media sheet guide plate 26 while media transport rollers 24 continue to force media sheet 8 towards media sheet guide plate 26. At this point, buckle 42 is created. Once buckle 42 is formed, page wide rollers 40 move in the direction of arrow x in order to force media sheet 8 against an edge of media sheet guide plate 26 so that a crease in media sheet 8 is formed.

As shown in FIG. 6*c*, page wide rollers 40 then move in the direction of arrow x' in order to make a second crease at the same point in media sheet 8, but on the other side of media sheet 8. In this manner, media sheet 8 only needs to be stopped by media drive rollers 28 at the desired locations along media sheet 8, clamped by media bail clamp 30, and then acted upon by page wide rollers 40 in order to form the various creases along media sheet 8.

Figure 7A:
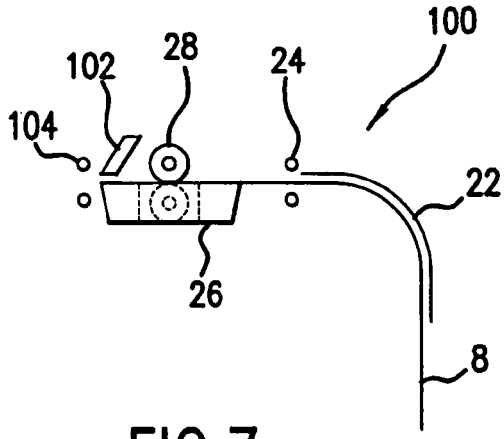
FIG. 7 is a schematic illustration of the steps (FIG. 7*a*–FIG. 7*c*) for completing a 240 degree double parallel fold, according to another embodiment of the present invention.
Figure 7B:
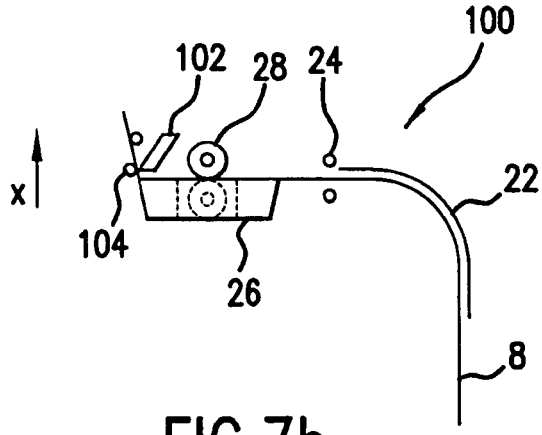
Figure 7C:
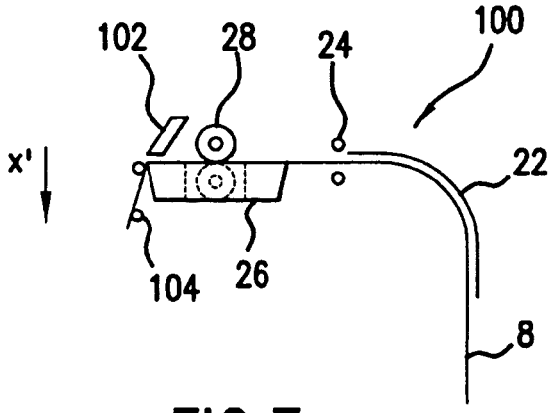

With respect to FIG. 7, there is illustrated another embodiment for creasing media sheet 8. FIGS. 7*a*–7*c* illustrate apparatus 100 for creating a 240 degree fold to crease media sheet 8. Apparatus 100 includes, in part, media sheet 8, media guide 22, media transport rollers 24, media sheet guide plate 26, media drive rollers 28, media crease bar 102, and page wide rollers 104.

Media crease bar 102, preferably, is constructed of any suitable, durable material that is capable of creasing media 8 when acted upon by rollers 104. Page wide rollers 104, preferably, are constructed of any suitable, durable material that is capable of pushing a portion of media sheet 8 against an edge of media sheet guide plate 26 and media crease bar 102 in order to form a crease in media sheet 8. It is to be understood that the clearance between media sheet guide plate 26 and media crease bar 102 is such that media 8 can easily move between plate 26 and bar 102, and allow media sheet 8 to be properly creased without movement of media sheet 8 along plate 26 and bar 102. It is also to be understood that the clearance between plate 26 and bar 102 can be adjusted according to techniques known to those skilled in the art so as to compensate for different media thicknesses.

During the operation of apparatus 100, as shown in FIG. 7*a*, media sheet 8 is conventionally fed along media guide 22 such that media sheet 8 interacts with media transport rollers 24. Media transport rollers 24 cause media sheet 8 to slide along media sheet guide plate 26 and under media crease bar 102. At this point, page wide rollers 104 are not in contact with media sheet 8 and media drive rollers 28 take control of media sheet 8 and attempt to locate the predetermined crease points along media sheet 8.

As shown in FIG. 7*b*, page wide rollers 104 move in the direction of arrow x in order to force media sheet 8 against an edge of media crease bar 102 so that a crease in media sheet 8 is formed.

As shown in FIG. 7*c*, page wide rollers 104 then move in the direction of arrow x' to force media sheet 8 against an edge of media sheet guide plate 26 in order to make a second crease at the same point in media sheet 8, but on the other side of media sheet 8. In this manner, media sheet 8 only needs to be stopped by media drive rollers 28 at the desired locations along media sheet 8, and then acted upon by page wide rollers 104 in order to form the various creases along media sheet 8.

With reference to FIG. 8, there is illustrated another embodiment for creasing media sheet 8. FIGS. 8*a*–8*i* illustrate an apparatus 150 for creating a 360 fold to crease media sheet 8. Apparatus 150 includes, in part, media sheet 8, media transport rollers 24, media drive rollers 28, media creasing rollers 152 and 154, top insert roller 156, and lower insert roller 158. Media creasing rollers 152 and 154, preferably, are constructed of any suitable, durable material that is capable of forming a nip between media drive rollers 28 and media creasing rollers 152 and 154. This nip is where the crease is formed in media sheet 8. Top and lower insert rollers 156 and 158 are constructed of any suitable, durable material that is capable of forcing a portion of media sheet 8 into the nip located between media drive rollers 28 and media creasing rollers 152 and 154, respectively.

Figure 8A:
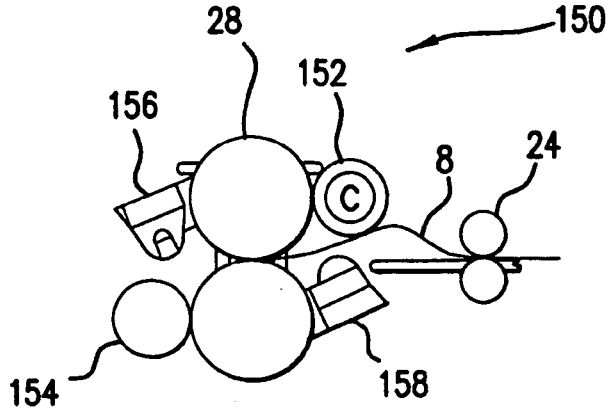
FIG. 8 is a schematic illustration of the steps (FIG. 8*a*–FIG. 8*i*) for completing a 360 degree double fold, according to another embodiment of the present invention.
Figure 8B:
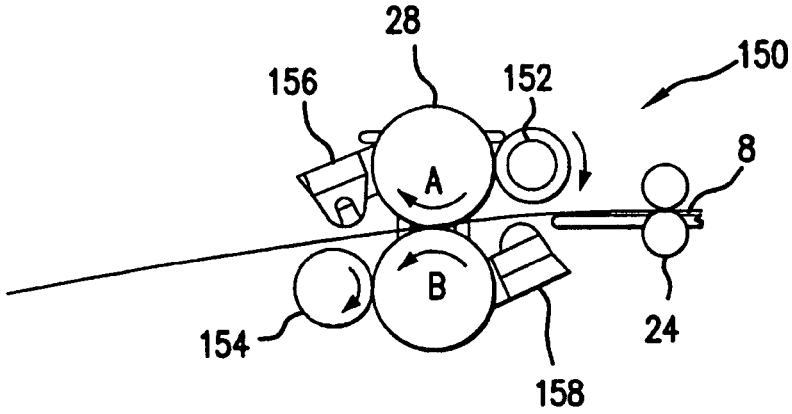

During the operation of apparatus 50, as shown in FIGS. 8*a* and 8*b*, media sheet 8 is traversed towards apparatus 150 by media transport rollers 24. Media sheet 8 interacts with the nip located between the two media drive rollers 28. At this point, top and lower insert rollers 156 and 158, respectively, are not in contact with media sheet 8 and media drive rollers 28 take control of media sheet 8 and attempt to locate by rotation of media drive rollers 28 (along the direction of arrows A and B) the predetermined crease points along media sheet 8.

Figure 8C:
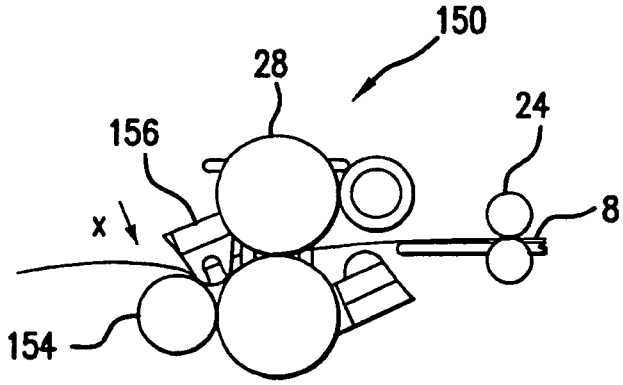

With respect to FIG. 8*c*, top insert roller 156 forces a portion of media sheet 8 into the nip located between media drive roller 28 and media creasing roller 154 along the direction of arrow x.

Figure 8D:
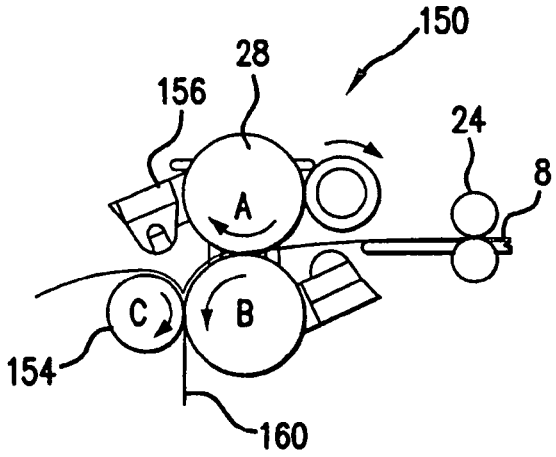

With respect to FIG. 8*d*, a first crease is formed in media sheet 8 by the rotation of media drive roller 28 along the direction of arrow B and the rotation of media creasing roller 154 along the direction of arrow C. Also, top insert roller 156 is moved away from the nip located between media drive roller 28 and media creasing roller 154 along the direction of arrow x'.

Figure 8E:
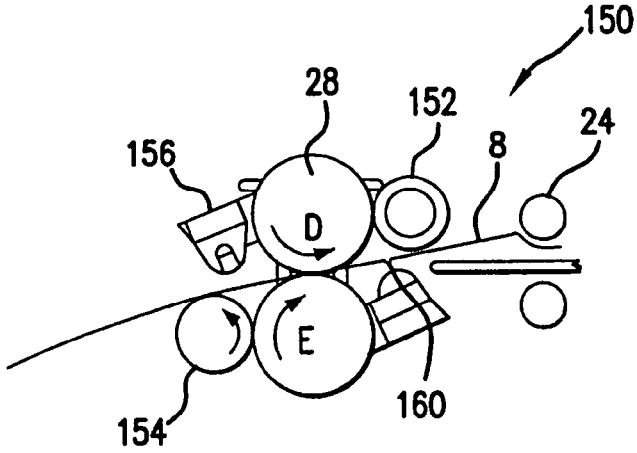

With respect to FIG. 8*e*, media sheet 8 is traversed towards media transport rollers 24 by the rotation of media drive roller 28 along the direction of arrows D and E. In this manner, crease 160 is located substantially over the nip located between media drive roller 28 and media creasing roller 152.

Figure 8F:
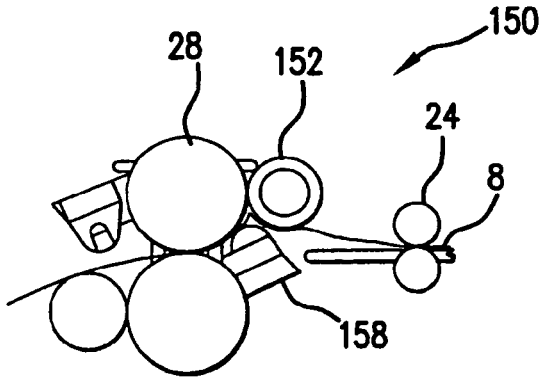

With respect to FIG. 8*f*, lower insert roller 158 forces crease 160 of media sheet 8 into the nip located between media drive roller 28 and media creasing roller 152 along the direction of arrow y.

Figure 8G:
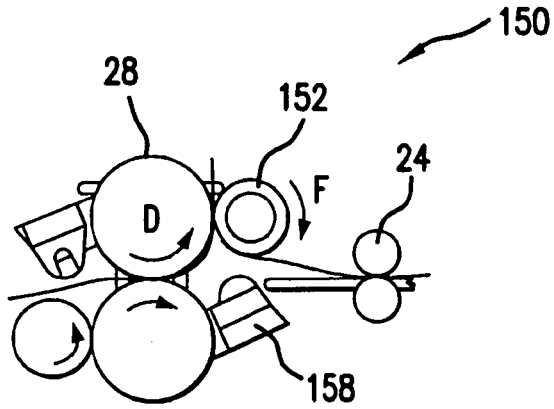

With respect to FIG. 8*g*, media sheet 8 is creased on the other side of crease 160 by the rotation of media drive roller 28 along the direction of arrow D and the rotation of media creasing roller 152 along the direction of arrow F. Also, lower insert roller 158 is moved away from the nip located between media drive roller 28 and media creasing roller 152 along the direction of arrow y'.

Figure 8H:
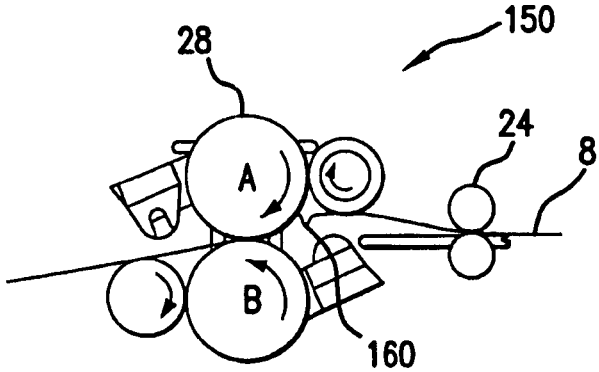

With respect to FIG. 8*h*, media sheet 8 is traversed towards media creasing roller 154 through the rotation of media drive rollers 28 along the direction of arrows A and B.

Figure 8I:
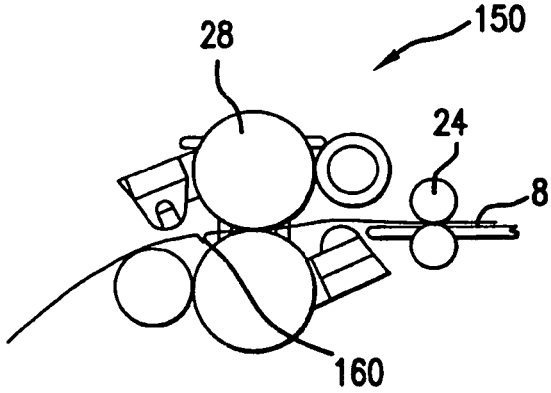

Finally, with respect to FIG. 8*i*, media sheet 8 is traversed by media drive rollers 28 until a portion of media sheet 8, upon which another crease in media sheet 8 is to the formed, is located substantially adjacent to the nip located between media drive roller 28 and media creasing roller 154. Once the second location has been achieved, the second crease (not shown) can be formed according to the previously discussed steps as shown in FIGS. 8*a*–8*h*.

Once media sheet 8 has been creased in at least two positions, media sheet 8 is forwarded to a conventional sheet-accumulating device. After the desired number of creased media sheets 8 has been collected to form a bundle, a final alignment or registration of the bundle is completed. Finally, the bundle is fastened and a finished booklet is ejected.

Figure 9B:
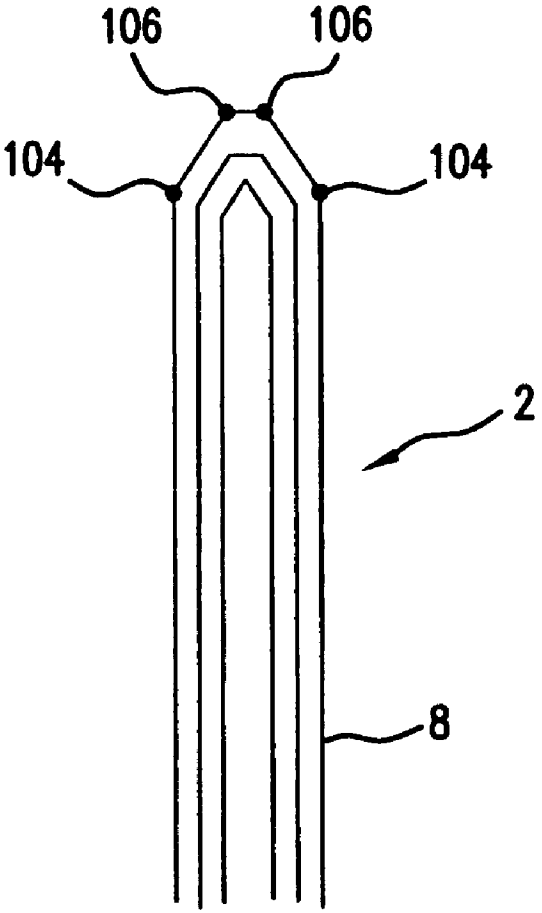
FIG. 9 is a schematic illustration showing that multiple folds in the booklet spine are also possible, according to another embodiment of the present invention.
Figure 9A:
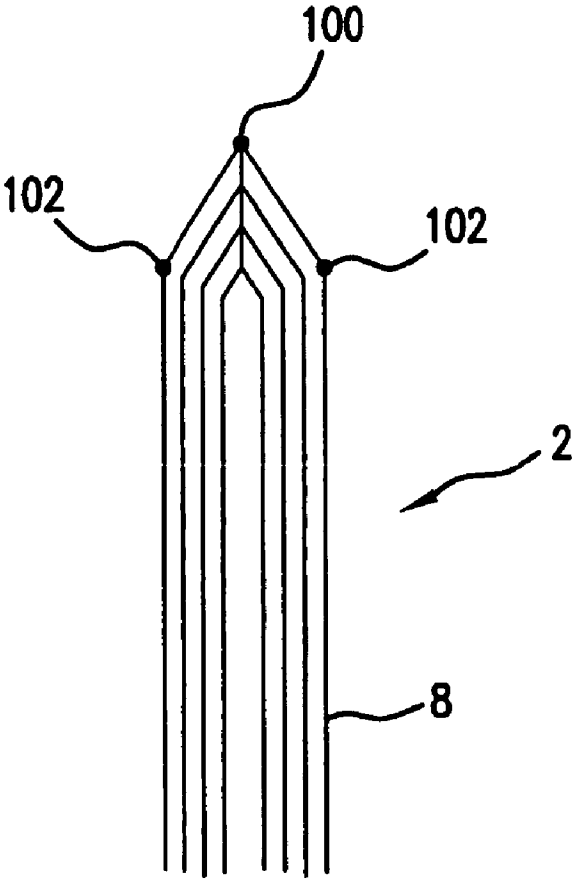

With respect to FIG. 9, it is to be understood that any number of creases can be formed on media sheets 8 of booklet 2. For example, as shown in FIG. 9*a*, media sheets 8 have been creased at three points (100, 102,102). As shown in FIG. 9*b*, media sheets 8 have been creased at four points (104,106,106, 104). It is to be understood that having more folds on every media sheet 8 could give better results. Clearly, as the number of folds increases and the angle subtended by media sheet 8 decreases, plastic deformation requirements for media sheet 8 are reduced which, in turn, reduces pillowing and increases the tendency of the booklet to lay flat.

Also, the present invention can be embodied in any computer-readable medium for use by or in connection with an instruction-execution system, apparatus or device such as a computer/processor based system, processor-containing system or other system that can fetch the instructions from the instruction-execution system, apparatus or device, and execute the instructions contained therein. In the context of this disclosure, a "computer-readable medium" can be any means that can store, communicate, propagate or transport a program for use by or in connection with the instruction-execution system, apparatus or device. The computer-readable medium can comprise any one of many physical media such as, for example, electronic, magnetic, optical, electromagnetic, infrared, or semiconductor media. More specific examples of a suitable computer-readable medium would include, but are not limited to, a portable magnetic computer diskette such as floppy diskettes or hard drives, a random access memory (RAM), a read-only memory (ROM), an erasable programmable read-only memory, or a portable compact disc. It is to be understood that the computer-readable medium could even be paper or another suitable medium upon which the program is printed, as the program can be electronically captured, via, for instance, optical scanning of the paper or other medium, then compiled, interpreted or otherwise processed in a single manner, if necessary, and then stored in a computer memory.

Those skilled in the art will understand that various embodiment of the present invention can be implemented in hardware, software, firmware or combinations thereof. Separate embodiments of the present invention can be implemented using a combination of hardware and software or firmware that is stored in memory and executed by a suitable instruction-execution system. If implemented solely in hardware, as in an alternative embodiment, the present invention can be separately implemented with any or a combination of technologies which are well known in the art (for example, discrete-logic circuits, application-specific integrated circuits (ASICs), programmable-gate arrays (PGAs), field-programmable gate arrays (FPGAs), and/or other later developed technologies. In preferred embodiments, the present invention can be implemented in a combination of software and data executed and stored under the control of a computing device.

Once given the above disclosure, many other features, modifications or improvements will become apparent to the skilled artisan. Such features, modifications or improvements are, therefore, considered to be a part of this invention, the scope of which is to be determined by the following claims.

What is claimed is:

1. An apparatus for making a booklet, comprising:

a media sheet feeder;

a media sheet traverser located substantially adjacent to said media sheet feeder;

a media sheet creaser located substantially adjacent to said media sheet traverser, further comprising; a first media guide plate, a first clamp located substantially along said first media guide plate, a first media buckler operatively connected to said first clamp, and a first creasing roller operatively connected to said first clamp and said first media buckler;

a creased media sheet collector located substantially adjacent to said media sheet creaser;

a creased media sheet fastener located substantially adjacent to said creased media sheet collector; and a booklet ejector located substantially adjacent to said creased media sheet fastener.

2. The apparatus, as in claim 1 wherein said media sheet feeder is further comprised of:

a media guide; and a plurality of media transport rollers located substantially adjacent to said media guide.

3. The apparatus, as in claim 1 wherein said media sheet traverser is further comprised of:

a plurality of media drive rollers.

4. The apparatus, as in claim 1 wherein said media sheet creaser is further comprised of:

a second media guide plate;

a second clamp located substantially along said second media guide plate; and a plurality of second creasing rollers operatively connected to said second clamp.

5. The apparatus, as in claim 1, wherein said media sheet creaser is further comprised of:

a third media guide plate; and a plurality of third creasing rollers operatively connected to said third media guide plate.

6. The apparatus, as in claim 5, wherein said third media guide plate is further comprised of:

a media crease bar.

7. The apparatus, as in claim 1, wherein said media sheet creaser is further comprised of:

a fourth creasing roller operatively connected to said media traverser;

a first insert roller located substantially adjacent to said fourth creasing roller;

a fifth creasing roller operatively connected to said media traverser; and a second insert roller located substantially adjacent to said to creasing roller.

8. A booklet making means, comprising:

a media sheet feeder means for feeding a sheet of media;

a means for traversing a sheet of media from said media sheet feeder means;

a means for creasing said sheet of media, further comprising; a first clamping means, a means for creating a first buckle in a first side of said sheet of media, a means for creating a first crease in said sheet of media, a means for creating a second buckle in a second side of said sheet of media, and a means for creating a second crease in said sheet of media such that said second crease is located substantially adjacent to said first crease;

a means for collecting creased sheets of media;

a means for fastening said collected, creased sheets of media; and a means for ejecting a booklet.

9. The booklet making means, as in claim 8, wherein said creasing means is further comprised of:

a second clamping means; and a first roller means for creating a first crease in a first side of said sheet of media and a second crease in a second side of said sheet of media located substantially adjacent to said first crease.

10. The booklet making means, as in claim 8, wherein said creasing means is further comprised of:

a crease bar means; and a second roller means for creating a first crease in a first side of said sheet of media and a second crease in a second side of said sheet of media located substantially adjacent to said first crease.

11. The booklet making means, as in claim 8, wherein said creasing means is further comprised of:

a first creasing roller means;

a first insert roller means for interacting with said first creasing roller means in order to form a first crease in a first side of said sheet of media;

a second creasing roller means; and a second insert roller means for interacting with said second creasing roller means in order to form a second crease in a second side of said sheet of media located substantially adjacent to said first crease.

* * * * *